US005647791A

United States Patent [19]

Erlenkotter

[11] Patent Number: 5,647,791

[45] Date of Patent: Jul. 15, 1997

[54] PROCESS FOR GRINDING ROTATING RUBBER ROLLS AND MEANS FOR CARRYING OUT THIS PROCESS

[75] Inventor: Jurgen Erlenkotter, Ennepetal, Germany

[73] Assignee: Felix Bottcher GmbH & Co., Cologne, Germany

[21] Appl. No.: 558,087

[22] Filed: Nov. 13, 1995

[30] Foreign Application Priority Data

Nov. 12, 1994 [EP] European Pat. Off. ..... 94117909

[51] Int. Cl.[6] ..... B24B 1/00

[52] U.S. Cl. ..... 451/49; 451/56; 451/54; 451/197; 451/246; 451/254; 451/444

[58] Field of Search ..... 451/56, 541, 197, 451/299, 49, 54, 55, 242, 246, 254, 444

[56] References Cited

U.S. PATENT DOCUMENTS

| | | | |
|---|---|---|---|
| 3,290,834 | 12/1966 | Lindblad | 451/541 |
| 4,475,321 | 10/1984 | Meyer | 451/56 |
| 4,557,078 | 12/1985 | Brill | 451/56 |
| 4,685,440 | 8/1987 | Owens | 451/547 |
| 4,731,954 | 3/1988 | Lilienfein | 451/56 |
| 4,809,465 | 3/1989 | Mushardt et al. | 451/541 |

*Primary Examiner*—Eileen Morgan

*Attorney, Agent, or Firm*—Jacobson, Price, Holman & Stern, PLLC

[57] ABSTRACT

The process for grinding a rotating rubber roll by means of a grinding wheel is taking place in such a way that at least during the last grinding cut a rotating plugging roll is applied to the grinding wheel which plugging roll has a harder rubber than the rubber roll.

11 Claims, 1 Drawing Sheet

PROCESS FOR GRINDING ROTATING RUBBER ROLLS AND MEANS FOR CARRYING OUT THIS PROCESS

The subject matter of the present invention is a process for grinding rotating rubber rolls by means of a grinding wheel and an auxiliary device for carrying out the process.

Rotating rubber rolls are worked a long time with rotating grinding wheels in order to get a uniform surface which has a sufficient roughness value. When grinding with commercially available base wheels, for instance, having a granularity of 60, 80 and 100, the grindstone will be clogged up during the work by the abraded material from the rubber roll. Thereby, the handle—also denominated as cut—of the grindstone being lost. This will lead to greasing on the surface during further work. This will result in many different surface structures within a rubber roll, as well as in deviations of the geometry by irregular material abrasion.

Therefore, the grinding wheel was stripped manually in the past with a so-called cleaning rubber during the abrasive cutting. Timing of the cleaning process was the machine operator's duty. Since the grinding wheel can not be cleaned permanently, surface structure and roughness values were varying on a larger scale. Therefore, due to the increased requirements of the customers, these rolls had to be polished again.

The invention has set the problem, to improve the process for grinding rotating rubber rolls by means of a grinding wheel, in such a way that uniform surface qualities and uniform roughness values are obtained, and, thereby, the deviations of geometry are as small as possible. In this case, the expenditure for polishing, if possible, should be maintained as low as possible.

It has been found now that this problem can be solved in a surprisingly simple and excellent manner by applying at least one rotating plugging roll, being made of a harder rubber than the rubber roll, to the grinding wheel, at least during the last grinding cut. This will lead, on the one hand, to the leaching from the wheel of the abraded rubber particles from the rubber rolls and, on the other hand, to plugging of the grinding wheel with the harder rubber from the harder-rubber plugging roll. Surprisingly, this leads to a much more uniform abrasion and a clearly finer surface structure of the rubber roll, such that even the first step of polishing can be abandoned. On the grindstone-applied rubber surface of the rubber roll, roughness coefficients (Rz) of between 1 to 12 μm can be attained. In this case, the Rz-values within a roll coating vary normally no more than 1 to 2 μm.

Figure 1:
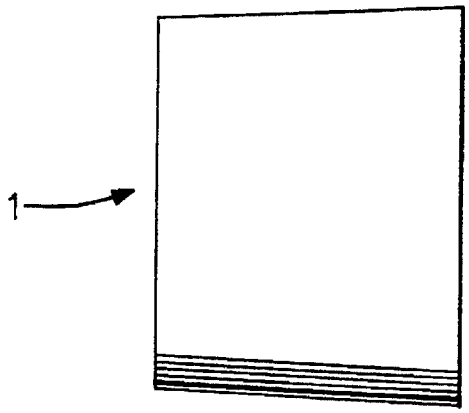
FIG. 1 is a side view of a cone-shaped rubber roll in accordance with the present invention.
Figure 2:
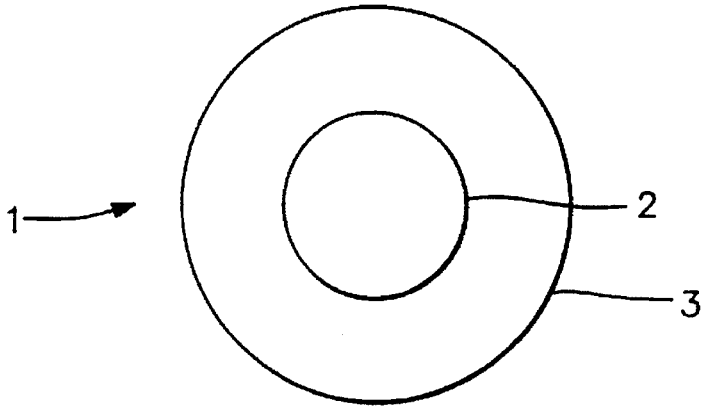
FIGS. 2 and 3 are opposing end views of the cone-shaped roll.
Figure 3:
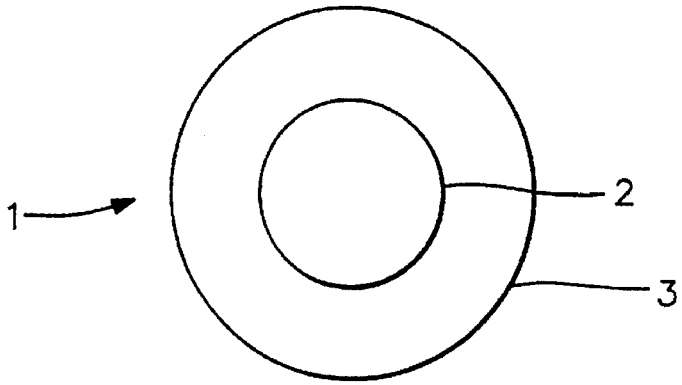

By means of the process according to the invention, also, the structure of the grinding wheel becomes finer. That means that, in practice, a grinding wheel having a granularity of 100 will get a granularity of 200. By this refinement of the structure of the grinding wheel, the surprisingly good, low roughness values are obtained, and the re-treatment by means of a polishing procedure is unnecessary.

As a material for the rubber coating of the rotating plugging roll, material having a hardness in the range of between 50 to 80 Shore A has been successful. Preferably, a material is used having a specific density of between 1.1 to 1.4 g/cm$^3$ and a elasticity of between 20 to 40%.

This material is preferably applied on a slightly conical core which can be driven in the form of a rotating axle.

The drive of this rotating plugging roll can be contrarotating or synchronously rotating in the cutting gap. When grindstone and plugging roll are contrarotating in the cutting gap, the plugging-roll rubber abrasion will be higher. When plugging roll and grinding wheel are synchronous in the cutting gap, finer surfaces will be obtained on the plugging-roll rubber. Since, upon use of the plugging rotating roll, the cut in the rotating rubber roll will be smaller, it is altogether possible to grind first of all in the usual manner, and to apply the plugging rotating roll against the grinding wheel only towards the end of cutting the rotating rubber roll. The application pressure should not be too high and not too low. Having a too low application pressure, too little of the rubber material is abraded such that the desired effect will not be obtained. Having a too high application pressure, the wear of the plugging rotating rubber roll is unnecessarily high without improving the results. Therefore, in practice, the optimum application pressure will be determined by simple experiments.

The size of the plugging rotating roll depends on the size of the width of the grinding wheel. Preferably, a size is selected which corresponds almost to the width of the grinding wheel, because in this case, on the one hand the whole grinding area of the grinding wheel can be brought into contact, on the other hand no protruding matter will be left which can lead to unnecessary consumption of material and, as the case may be, even to defects. As shown in the Figure, since the grinding wheels often have a thickness of 10 cm, the plugging rotating roll 1 will be selected that has a maximum width of 10.3 cm. The axle 2 of a typical plugging rotating roll has a diameter of between 4 to 6 cm. The initial circumference of the rubber coating 3 of the plugging roll, designated for abrasion, is between 10 to 15 cm. It has been particularly successful, when the axle and the rubber coating are arranged as a cone. In the accompanying figure is shown a preferred embodiment which has been outstandingly successful in practice.

What is claimed is:

1. In a process for grinding a rubber roll comprising rotating the rubber roll while applying, thereto, a rotating grinding wheel, the improvement comprising applying to the rotating grinding wheel at least one rotating plugging roll, which has a rubber surface possessing a Shore A Hardness greater than the Shore A Hardness of the rubber roll.

2. The process of claim 1 wherein the rubber surface of the plugging roll has a Shore A Hardness of 50–80.

3. The process of claim 1 wherein the rubber surface of the plugging roll has a specific density of 1.1–1.4 g/cm$^3$ and an elasticity of 20–40%.

4. The process of claim 1 wherein the plugging roll rotates at a speed, relative to the rotation speed of the grinding wheel, to effect constant abrasion of the rubber surface of the plugging roll by the grinding wheel.

5. The process of claim 1 wherein the rubber roll, grinding wheel, and plugging roll rotate synchronously.

6. In a machine for grinding a rubber roll including:

a) a grinding wheel having a cutting surface that works by rotation and b) means for rotating a rubber roll so as to be worked by said cutting surface;

the improvement wherein the machine further includes:

c) an auxiliary device comprising:

(1) a plugging roll having a rubber surface and (2) means for applying the plugging roll against the grinding wheel cutting surface, such that rubber, abraded from said rubber surface, plugs said cutting surface in a manner that effects a finer cut in said cutting surface.

7. The machine of claim 6 wherein the plugging roll is cone-shaped.

8. The machine of claim 7 wherein the plugging roll comprises of cone-shaped axle having disposed thereon a correspondingly cone-shaped rubber coating.

9. The machine of claim 7 wherein the rubber coating has a specific density of 1.1–1.4 g/cm$^3$ a Shore A Hardness of 50–80 and an elasticity of 20–40%.

10. The machine of claim 6 wherein the rubber surface of the plugging roll has a specific density of 1.1–1.4 g/cm$^3$ a Shore A Hardness of 50–80 and an elasticity of 20–40%.

11. The machine of claim 10 wherein the plugging roll is cone-shaped.

* * * * *